US008146764B2

(12) United States Patent
Kral

(10) Patent No.: US 8,146,764 B2
(45) Date of Patent: Apr. 3, 2012

(54) COOLER WITH ADJUSTABLE HEIGHT AND REMOVABLE TABLE LID

(76) Inventor: Mark Kral, Hoschton, GA (US)

( * ) Notice: Subject to any disclaimer, the term of this patent is extended or adjusted under 35 U.S.C. 154(b) by 273 days.

(21) Appl. No.: 12/711,340

(22) Filed: Feb. 24, 2010

(65) Prior Publication Data

US 2011/0203307 A1 Aug. 25, 2011

(51) Int. Cl.
*B65D 6/16* (2006.01)

(52) U.S. Cl. ..... 220/8; 220/290; 220/4.21; 220/592.03

(58) Field of Classification Search ..... 220/290, 220/293, 300, 298, 4.06, 4.21, 8, 592.03
See application file for complete search history.

(56) References Cited

U.S. PATENT DOCUMENTS 2,763,394 A * 9/1956 Meek ..... 220/8
3,105,592 A * 10/1963 Cohen ..... 206/0.8
4,442,941 A * 4/1984 Keith ..... 206/540
4,784,112 A * 11/1988 Hayashi ..... 126/262
7,963,415 B2 * 6/2011 Perucci et al. ..... 220/320

* cited by examiner

*Primary Examiner* — Stephen Castellano
(74) *Attorney, Agent, or Firm* — Michael J. Mehrman; Mehrman Law Office, P.C.

(57) ABSTRACT

A barrel type cooler having an open top cylindrical icing chamber an open bottom cylindrical lid slidably that fits over the icing chamber. The icing chamber includes hooks and the lid includes slots, each slot configured to receive a hook and having an open bottom allowing the lid to be removed from engagement with the icing chamber. Each slot has a length sufficient to allow the lid to slide over the icing chamber to a closed position. In addition, each slot includes a side channel configured to engage a corresponding hook to support the lid in a raised position. The side of the top has ingress openings allowing a user to reach through the side of the lid and into the icing chamber when the lid is supported by the icing chamber in the raised position.

8 Claims, 2 Drawing Sheets

COOLER WITH ADJUSTABLE HEIGHT AND REMOVABLE TABLE LID

TECHNICAL FIELD

The present invention relates to coolers for icing beverages and other items and, more particularly, to a cooler with a lid that serves as a table that is adjustable in height above the cooler and may be removed from the cooler.

BACKGROUND OF THE INVENTION

There is always a need for a better cooler suitable for use when tailgating, on the beach, on the deck, at the soccer field and any other location where iced beverages are in order. While there have been numerous cooler designs over the years, they all reflect design tradeoffs and have drawbacks. Of course, different occasions are best served by different cooler designs. The best design when the cooler needs to be easily portable when empty but does not generally need to be moved while full has yet to be realized. This type of cooler will be most suitable for use when tailgating, on the beach, on the deck, and so forth.

SUMMARY OF THE INVENTION

The present invention meets the needs described above in a barrel type cooler with a lid that serves as a table that is adjustable in height above the cooler and may be removed from the cooler. More particularly, the cooler includes an icing chamber forming a cylinder having an open top and a lid having a table top and a side forming a cylinder with an open bottom configured to be slidably received over the top of the icing chamber. The icing chamber includes one or more hooks and the lid includes one or more slots, each slot configured to receive a hook and having an open bottom allowing the lid to be removed from engagement with the icing chamber. For example, the cooler may have four slots in the lid and four corresponding hooks carried by the icing chamber.

Each slot has a length sufficient to allow the lid to slide over the icing chamber to a closed position. In addition, each slot includes a side channel configured to engage a corresponding hook to support the lid in a raised position. The side of the top further includes one or more ingress openings allowing a user to reach through the side of the lid and into the icing chamber when the lid is supported by the icing chamber in the raised position.

The cooler may also include at least two cut outs through the icing chamber forming hand holds for lifting the cooler. The cut outs align with the one or more ingress openings when the lid is engaged on the icing chamber in the closed position. The cooler may also include an insert, which may be removable, near the top of the icing chamber icing chamber having an ingress opening allowing a user to reach through the ingress opening in the side of the lid and through the ingress opening in the insert into the icing chamber when the lid is in the raised position. The hooks may include portions that extend into the interior of the cooling chamber forming chocks for supporting the insert.

The table top formed by the lid may have one or more indentations forming cup holders and one or more indentations in addition to the cup holders. In an illustrative embodiment, the lid has four cup holders around the perimeter and a central indentation, which may be used to hold chips, keys, or other items.

DETAILED DESCRIPTION OF THE PREFERRED EMBODIMENTS

The present invention may be embodied in a barrel type cooler with a lid that serves as a table that is adjustable in height above the cooler and may be removed from the cooler to serve as a separate table or seat. The icing chamber of the cooler may be constructed from insulated plastic similar to other barrel type coolers. The lid may also be constructed from suitable plastic, with the sides preferably thinner than the icing chamber, sized to slide to fit snugly over the top of the icing chamber while allowing the lid to slide up and down over the icing chamber. The icing chamber may be dual sided and closed call foam core sufficiently sturdy to support an adult sitting on the cooler with the lid in the closed position. The lid and icing chamber are both suitable for manufacture in large quantity using blow molds, injection molds or other suitable types of molds.

The lid may have foam core or solid plastic sides with a dual sided foam core lid that preferably includes insets for cup and chip holders. The lid includes a set of slots with side channels. The slots receive hooks connected to the icing chamber allowing the lid to slide up and down on the icing chamber with the hooks extending through the slots. The lid may be rotated to engage the hooks in the side channels to support the lid on the icing chamber in the raised position. The lid should be sufficiently sturdy to support an adult sitting on the lid with the lid removed from the icing chamber and placed on a horizontal support surface.

The lid includes ingress openings allowing a user the reach through the lid into the icing chamber when the lid is in the raised position. The icing chamber includes handle cut outs that align with the ingress openings in the lid to allow the user to pick up the cooler by the handle cut outs with the lid in the closed position. The cooler may also include an insert that fits inside the icing chamber supported on the portions of the hooks that extend into the interior of the icing chamber. The insert includes an opening allowing ingress into the icing chamber and a shelf. Thus, with the lid in the raised position, the cooler includes both an upper lid and an internal shelf protected by the lid.

Figure 1:
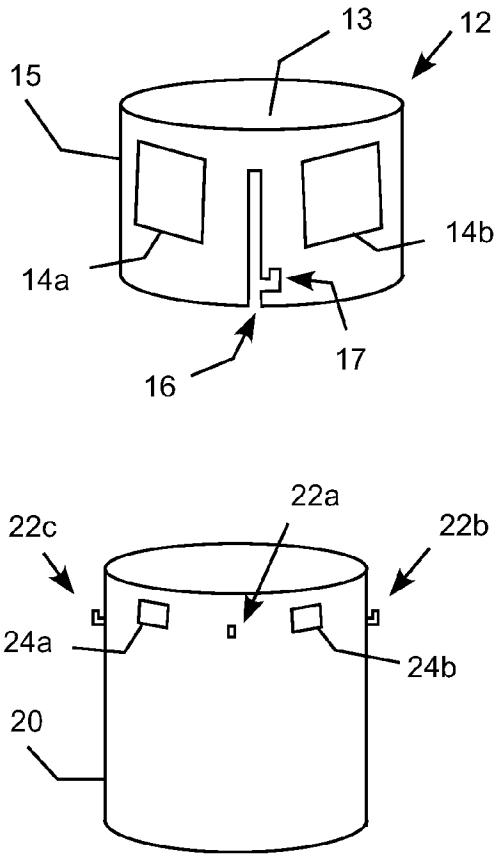
FIG. 1 is a front perspective view of an illustrative cooler according to the present invention with the lid removed from the icing chamber.
Figure 2:
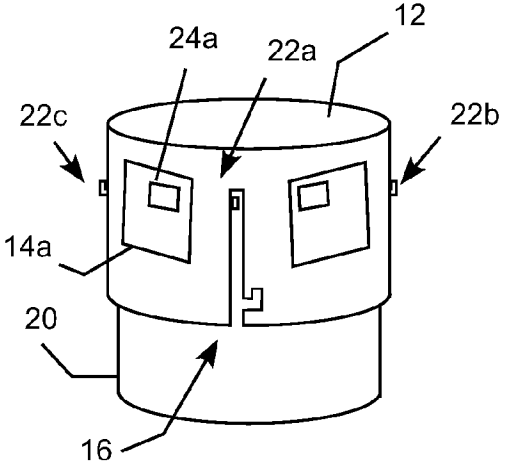
FIG. 2 is a front perspective view of the cooler with the lid closed.
Figure 3:
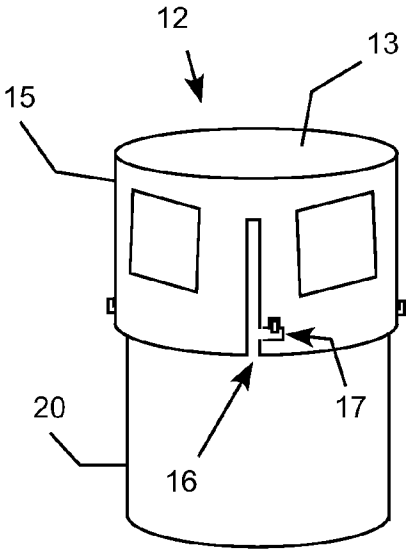
FIG. 3 is a front perspective view of the cooler with the lid raised.

Turning now to the figures, in which like numerals refer to similar features throughout the figures. It should be understood that the elements of the invention are shown in conceptual line drawing format but in reality have appropriate thickness and other customary, nonessential featured that are not illustrated to avoid cluttering the conceptual illustrations. FIG. 1 is a front perspective view of an illustrative cooler 10 with a lid 12 removed from an icing chamber 20. FIG. 2 shows the cooler with the lid in the closed position and FIG. 3 shows the cooler with the lid in the raised position.

The lid 12 includes a table top 13 and a side 15 extending downward from the table top forming an open bottom cylinder. The side includes ingress openings spaced around the side of the lid represented by the slot represented by the openings 14*a* and 14*b*. The lid also includes vertical slots spaced around the side of the lid represented by the slot 16. There are preferably three or four slots, although one slot may be sufficient and additional slots may be provided as a matter of design choice. Similarly, there are preferably four ingress openings, although one ingress opening is sufficient and additional ingress opening may be provided as a matter of design choice. The slot 16 is sufficiently long to allow the lid to slide along the icing chamber into the closed position, includes a side channel 17 for hooking the lid in the raised position, and has an open bottom to allow the lid to be removed from the icing chamber 20.

The icing chamber 20 forms an open top cylinder that slidably receives the lid 12. The icing chamber includes a number of hooks spaced around the icing chamber represented by the hooks 22*a-c*. The hooks align with slots in the lid allowing the lid to be slidably received over the icing chamber with the hooks extending through the slots. The slot 16 has an open bottom allowing the lid 12 to be removed from the icing chamber 20, as shown in FIG. 1. Referring to the representative hook 22*a*, the lid 12 may also be placed over the icing chamber 20 with the hook 22*a* aligned with the slot 16. The lid 12 may then be slid down to align the hook 22*a* with the side channel 17. The lid is then rotated slightly to engage the hook 22*a* with the side channel 17 to support the lid in the raised position, as shown in FIG. 2. The lid may also be slid all the way down along the icing chamber 20 until the hook 22*a* is at the top of the slot 16 or the lid bottoms out against the icing chamber to the place the lid in the closed position, as shown in FIG. 3.

The ingress openings represented by the openings 14*a* and 14*b* allow a user to reach through the lid 12 into the icing chamber 20 when the lid is in the raised position. In addition, the icing chamber includes handle cut outs represented by the cut outs 24*a* and 24*b* that align with the ingress openings in the lid to allow the user to pick up the cooler by the handle cut outs with the lid in the closed position.

Figure 7:
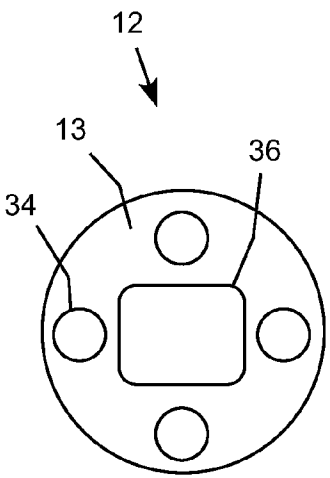
FIG. 7 is a top view of cooler lid.
Figure 6:
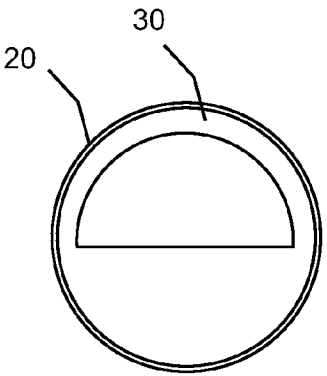
FIG. 6 is a top view of the icing chamber of the cooler with the insert installed.
Figure 5:
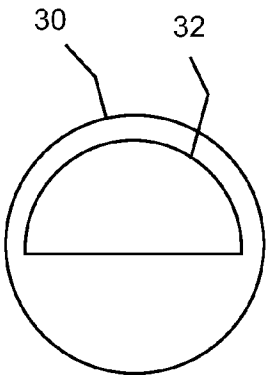
FIG. 5 is a top view of an insert for the icing chamber of the cooler.
Figure 4:
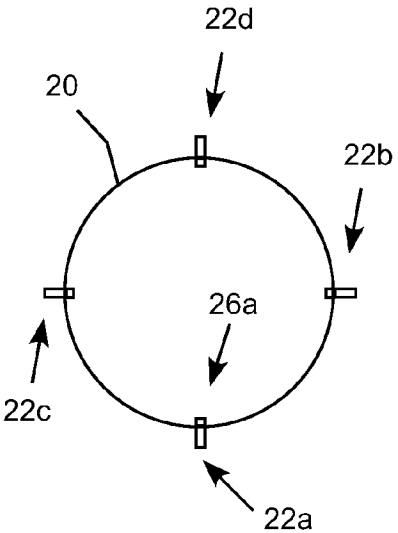
FIG. 4 is a top view of the icing chamber of the cooler.

FIG. 4 is a top view of the icing chamber of the cooler. The illustrated embodiment includes four hooks 22*a-d*, which provides a stable foundation for the lid 12 in the raised position. Each hook may be a two-piece structure that engages a hole through the icing chamber fastened with a screw, bolt, barb or other suitable connector. Each hook may extend into the interior of the icing chamber forming chocks to support a shelf insert near the top of the icing chamber. FIG. 5 is a top view of an illustrative insert 30, which includes an ingress opening 32 allowing a user to reach through the insert into the icing chamber of the cooler. The insert 30 fits inside the icing chamber supported on the chocks provided by the portions of the hooks that extend into the interior of the icing chamber. FIG. 6 is a top view of the icing chamber 20 of the cooler with the insert 30 installed. Thus, with the lid 12 in the raised position, the cooler includes both an upper table top 13 and an internal shelf protected by the insert. FIG. 7 is a top view of cooler lid 12 showing that the table top 13 may include a number of indentations, such as cup holders represented by the cup holder 34 and a chip holder 36. Of course the indentation configuration may be selected as a matter of design choice. In addition, the icing chamber and the lid as shown as round cylinders but may have any desired cross section. Square, rectangular, and pentagonal cylinders, for example, will also work well. The icing chamber and lid may also have a cone shown if desired.

The invention claimed is:

1. A cooler comprising:

an icing chamber forming a cylinder having an open top;

a lid having a table top and a side forming a cylinder with an open bottom configured to be slidably received over the top of the icing chamber;

the icing chamber having one or more hooks;

the lid having one or more slots, each slot configured to receive a hook and having an open bottom allowing the lid to be removed from engagement with the icing chamber;

each slot having a length sufficient to allow the lid to slide over the icing chamber to a closed position;

each slot further comprising a side channel configured to engage a corresponding hook to support the lid in a raised position; and the side of the lid comprising one or more ingress openings allowing a user to reach through the side of the lid and into the icing chamber when the lid is supported by the icing chamber in the raised position.

2. The cooler of claim 1, wherein the number of slots in the lid is four and the number of corresponding hooks carried by the icing chamber is four.

3. The cooler of claim 1, further comprising at least two cut outs through the icing chamber forming hand holds for lifting the cooler, wherein the cut outs align with the one or more ingress openings when the lid is engaged on the icing chamber in the closed position.

4. The cooler of claim 1, further comprising an insert near the top of the icing chamber having an ingress opening allowing a user to reach through the ingress opening in the side of the lid and through the ingress opening in the insert into the icing chamber when the lid is in the raised position.

5. The cooler of claim 4, wherein the insert is removable from the icing chamber.

6. The cooler of claim 5, wherein the hooks comprise portions that extend into the interior of the cooling chamber forming chocks for supporting the insert.

7. The cooler of claim 1, wherein the table top further comprises one or more indentations forming cup holders.

8. The cooler of claim 7, wherein the table top further comprises one or more indentations in addition to the cup holders.

* * * * *